US006394685B1

(12) United States Patent
Lee

(10) Patent No.: US 6,394,685 B1
(45) Date of Patent: May 28, 2002

(54) STRUCTURE OF A PAPER BINDER

(76) Inventor: Pei Chen Lee, P. O. Box 82-144, Taipei (TW)

( * ) Notice: Subject to any disclaimer, the term of this patent is extended or adjusted under 35 U.S.C. 154(b) by 0 days.

(21) Appl. No.: 09/860,542

(22) Filed: May 21, 2001

(51) Int. Cl.[7] ..... B42F 13/06
(52) U.S. Cl. ..... 402/14; 402/15; 402/64; 402/68
(58) Field of Search ..... 402/14, 15, 16, 402/17, 8, 60, 6, 64, 68, 62

(56) References Cited

U.S. PATENT DOCUMENTS 4,620,812 A * 11/1986 Kim ..... 402/14
4,979,841 A * 12/1990 Lauder ..... 402/15
5,011,318 A * 4/1991 Gilmore ..... 402/14
5,096,323 A * 3/1992 Walker ..... 402/15 X

* cited by examiner

*Primary Examiner*—Willmon Fridie, Jr.
(74) *Attorney, Agent, or Firm*—A & J

(57) ABSTRACT

A paper binder includes a binding plate formed with two portions which are bent inwardly into a bottom side of the binding plate for obviating sharp edge which could injure a user, a central portion of the binding plate being pressed to form a recessed portion to reinforce whole structure, the binding plate having two slots at two ends thereof, an inserting member having two shoulder portions which are bent inwardly on a top side of the inserting member to obviate sharp edges, the inserting member being a U-shaped member having two upwardly extending legs, a pair of sliding positioners which are U-shaped members slidably mounted on the binding plate, whereby when in use, papers having two holes punched therein are placed on the two legs of the inserting member by means of the holes, and then the two legs are placed in the slots of the binding plate, and the two legs can be flattened along the binding plate and the sliding positioners will then engage the legs thereby enabling all papers on the legs to be kept in place.

1 Claim, 4 Drawing Sheets

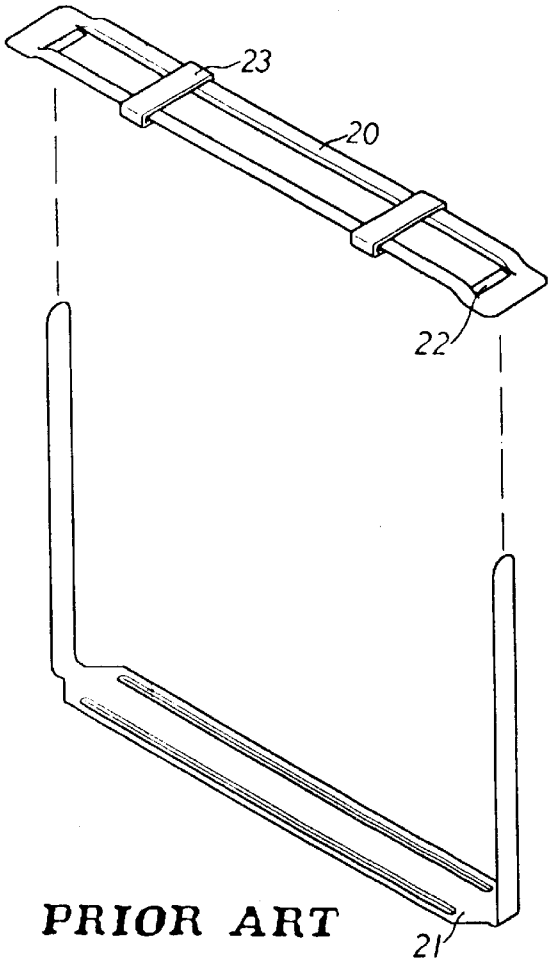
PRIOR ART
FIG. 6
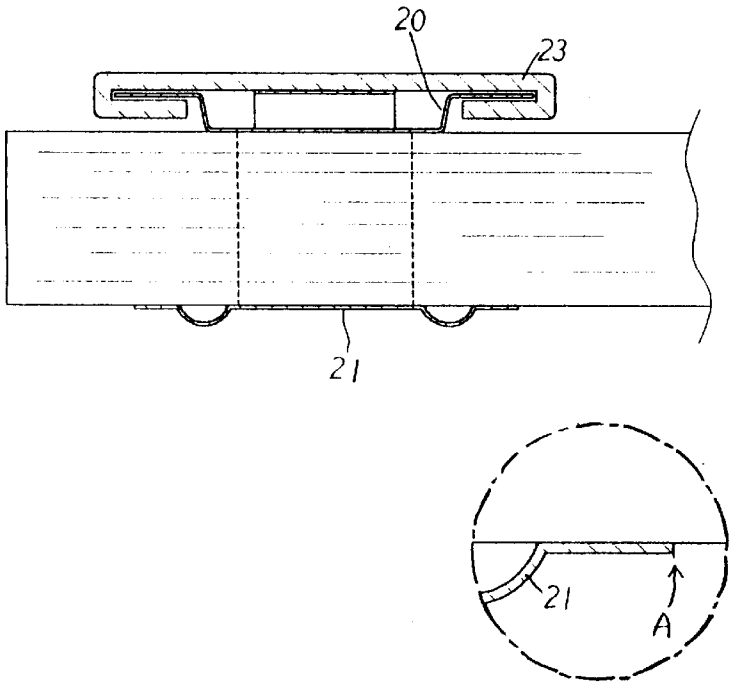
FIG. 7A
PRIOR ART
FIG. 7

STRUCTURE OF A PAPER BINDER

BACKGROUND OF THE INVENTION

1. Field of the Invention

This invention is related to an improvement in the structure of a paper binder and in particular to one which can remove any potential danger to the user to receive injury from any sharp edges and can ensure all documents being kept in place.

2. Description of the Prior Art

Because of the need for collecting documents, files are commonly used to meet this purpose. The conventional paper binder (as shown in FIG. 6 and FIG. 7) generally comprises a binding plate 20 and an inserting member 21. The binding plate 20 has a slot 22 at two ends and two sliding positioners 23 mounted on the binding plate 20. The inserting member 21 has two upwardly extending legs 11 for receiving documents with holes punched therein. When in use, the papers are placed on the two legs of the inserting member 21 by means of their holes, and then the two legs are placed in the slots 22 of the binding plate 20. The two legs can then be flattened along the binding plate 20 and the sliding positioners 23 will then engage the legs to fasten them, therefore enabling all papers on the legs to be kept in place.

However, this kind of paper binder suffers from two serious drawbacks. First, the two sides of the inserting member 21 connecting the two legs are sharp and may cause injury to the user. The other drawback is that the sliding positioners 23 have no means of remaining in a fixed position, and can easily move, thereby causing the bound papers to move out of place.

Therefore, it is an object of the present invention to provide an improvement in the structure of a paper binder which can obviate and mitigate the above-mentioned drawbacks.

SUMMARY OF THE INVENTION

This invention is related to an improvement in the structure of a paper binder.

It is the primary object of the present invention to provide an improvement in the structure of a paper binder which can remove any potential danger to the user to receive injury from any sharp edges.

It is another object of the present invention to provide an improvement in the structure of a paper binder which can ensure all documents being kept in place.

It is a further object of the present invention to provide an improvement in the structure of a paper binder which will not increase the cost of production, as it can be easily produced by a punching machine during production.

According to a preferred embodiment of the present invention, a paper binder includes a binding plate formed with two portions which are bent inwardly into a bottom side of the binding plate for obviating sharp edge which could injure a user, a central portion of the binding plate being pressed to form a recessed portion to reinforce whole structure, the binding plate having two slots at two ends thereof, an inserting member having two shoulder portions which are bent inwardly on a top side of the inserting member to obviate sharp edges, the inserting member being a U-shaped member having two upwardly extending legs, a pair of sliding positioners which are U-shaped members slidably mounted on the binding plate, whereby when in use, papers having two holes punched therein are placed on the two legs of the inserting member by means of the holes, and then the two legs are placed in the slots of the binding plate, and the two legs can be flattened along the binding plate and the sliding positioners will then engage the legs thereby enabling all papers on the legs to be kept in place.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 6 is an exploded view of a prior art paper binder;

FIG. 7 is a sectional view of the paper binder; and

FIG. 7A is an enlarged view of a portion of FIG. 7.

DETAILED DESCRIPTION OF THE PREFERRED EMBODIMENT

Figure 4:
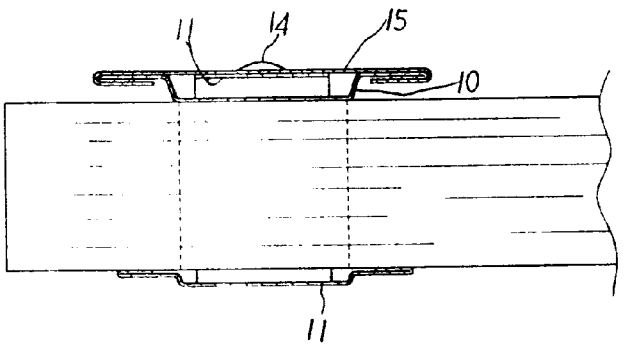
FIG. 4 is a sectional view showing the working principle of the present invention.
Figure 4A:
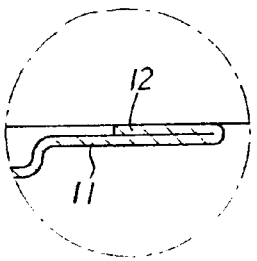
FIG. 4A is an enlarged view of a portion of FIG. 4.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 1:
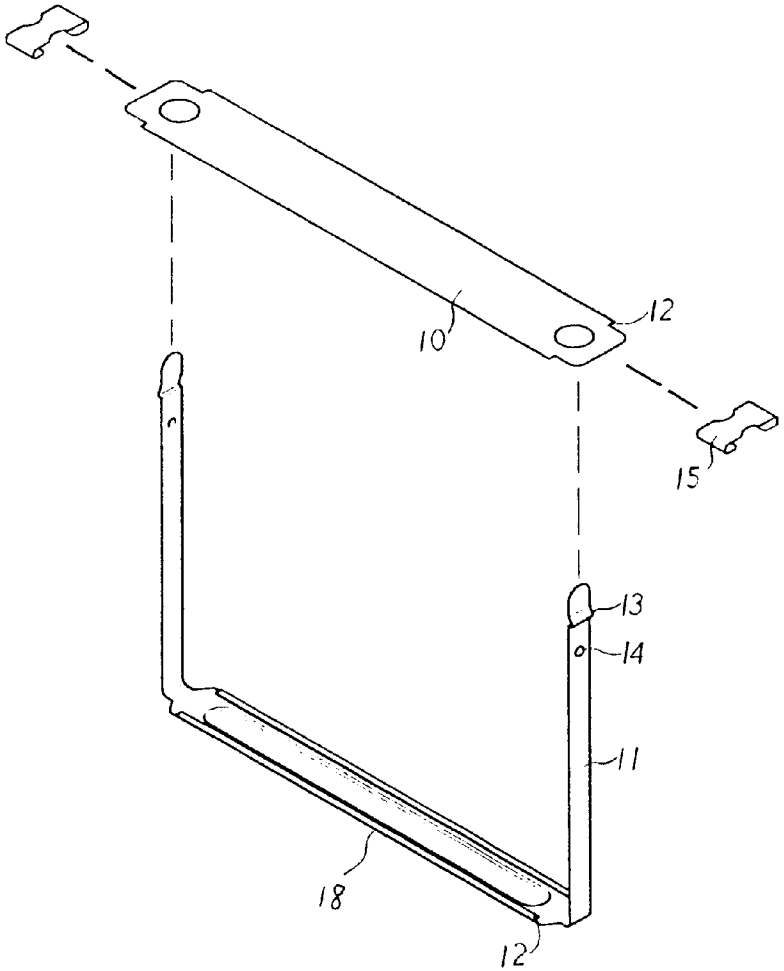
FIG. 1 is an exploded view of a paper binder according to the present invention, wherein the binding plate has not yet been processed.
Figure 2:
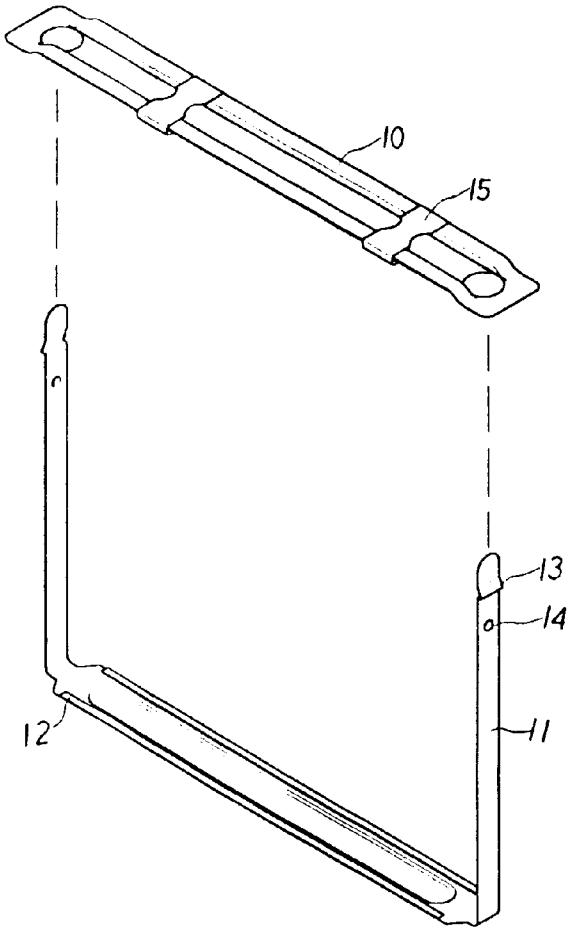
FIG. 2 is an another exploded view of the paper binder according to the present invention.
Figure 3:
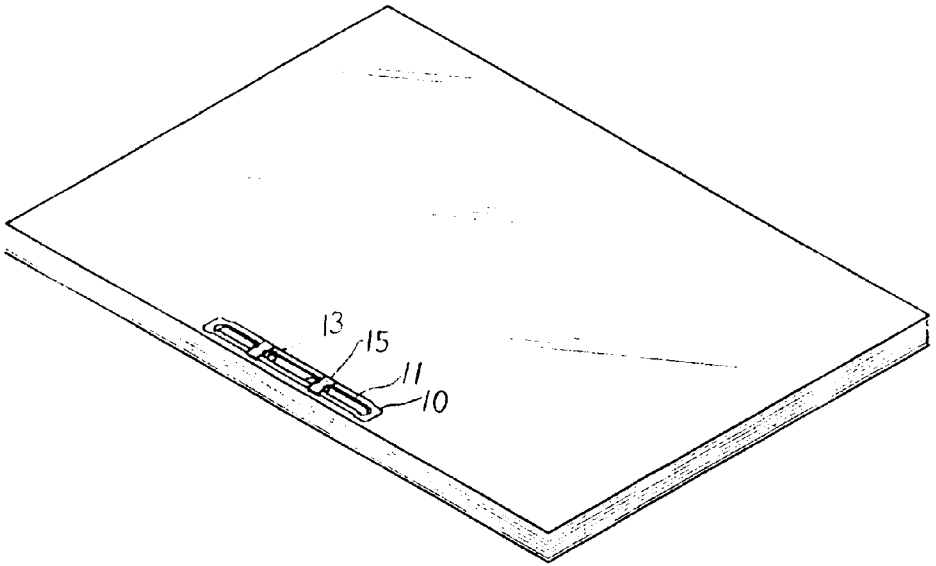
FIG. 3 illustrates an application of the present invention.
Figure 5A:
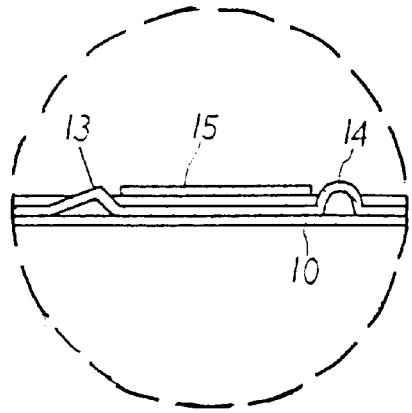
FIG. 5A is an enlarged view showing how the sliding positioner is kept in place.
Figure 5:
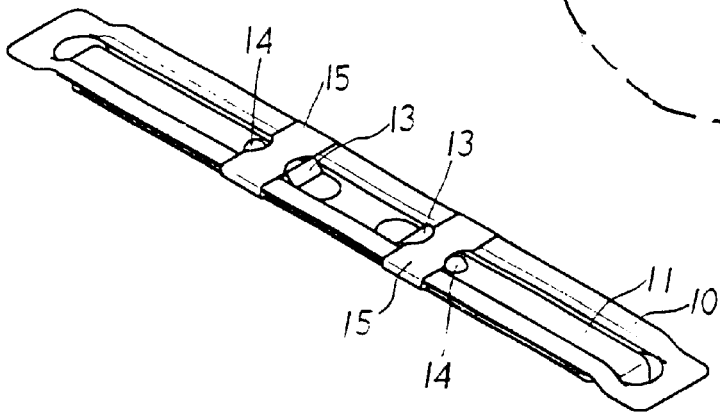
FIG. 5 is a perspective view of the present invention.

With reference to the drawings and in particular to FIGS. 1 through 5, the paper binder according to the present invention generally comprises a binding plate 10, an inserting member 18, and a pair of sliding positioners 15. The binding plate is formed with two shoulder portions which are bent inwardly into the bottom side of the binding plate for obviating the sharp edge which could injure a user. The central portion of the binding plate is pressed to form a recessed portion to reinforce the whole structure. The inserting member 18 also has two shoulder portions which are bent inwardly on the top side of the inserting member to obviate sharp edges. The inserting member 18 is a U-shaped member having two upwardly extending legs 11, each having a protuberance 14 and a portion 13 above the protuberance 14 which is outwardly angled in a triangular form. The two sliding positioners 15 are U-shaped members which are slidably mounted on the binding plate. When in use, the papers which have two holes punched therein are placed on the two legs 11 of the inserting member by means of the holes, and then the two legs 11 are placed in the slots 22 of the binding plate. The two legs 11 can then be flattened along the binding plate and the sliding positioners will then engage the legs between the protuberance 14 and the outwardly angled triangular protuberance 13 to fasten them, therefore enabling all papers on the legs 11 to be kept in place.

The advantages of the invention are that the shoulder portions of the binding plate and the inserting member remove any potential danger to the user to receive injury from any sharp edges. The addition of the protuberance 14 and outwardly angled rectangular protuberance 13 on the legs 11 enables the positioners 15 to remain in a fixed position, thus preventing their movement and ensuring all documents being kept in place. In addition, this invention will not increase the cost of production, as they can be easily produced by a punching machine during production.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A paper binder comprising:

a binding plate formed with two portions which are bent inwardly into a bottom side of said binding plate for obviating sharp edge which could injure a user, a central portion of said binding plate being pressed to form a recessed portion to reinforce whole structure, said binding plate having two slots at two ends thereof;

an inserting member having two shoulder portions which are bent inwardly on a top side of said inserting member to obviate sharp edges, said inserting member being a U-shaped member having two upwardly extending legs;

a pair of sliding positioners which are U-shaped members slidably mounted on said binding plate; and each of said legs having a protuberance, each of said legs having a portion above said protuberance which is outwardly angled in a triangular form;

whereby when in use, papers having two holes punched therein are placed on said two legs of said inserting member by means of the holes, and then said two legs are placed in said slots of said binding plate, and said two legs can be flattened along said binding plate and said sliding positioners will then engage said legs thereby enabling all papers on said legs to be kept in place.

* * * * *